US008070502B2

(12) United States Patent
Mitter et al.

(10) Patent No.: US 8,070,502 B2
(45) Date of Patent: Dec. 6, 2011

(54) ELECTRICAL CONNECTORS AND COUPLING DEVICE FOR SUCH A CONNECTOR

(75) Inventors: Alfred Mitter, Jettenbach (DE); Eduard Huber, Mettenheim (DE)

(73) Assignee: ODU Steckverbindungssysteme GmbH & Co. KG, Muhldorf am Inn (DE)

( * ) Notice: Subject to any disclaimer, the term of this patent is extended or adjusted under 35 U.S.C. 154(b) by 0 days.

(21) Appl. No.: 12/172,726

(22) Filed: Jul. 14, 2008

(65) Prior Publication Data

US 2009/0075508 A1 Mar. 19, 2009

(30) Foreign Application Priority Data

Jul. 12, 2007 (EP) ..... 07013728

(51) Int. Cl.
*H01R 4/60* (2006.01)

(52) U.S. Cl. ..... 439/252

(58) Field of Classification Search ..... 439/247, 439/248, 252, 246, 1, 2, 4, 6, 7, 8, 9, 10, 439/32, 33

See application file for complete search history.

(56) References Cited

U.S. PATENT DOCUMENTS

| | | | | |
|---|---|---|---|---|
| 3,737,558 | A * | 6/1973 | Seaquist | 174/86 |
| 5,440,073 | A * | 8/1995 | Lin et al. | 174/74 R |
| 6,312,295 | B2 * | 11/2001 | Nishimatsu | 439/700 |

FOREIGN PATENT DOCUMENTS

| | | |
|---|---|---|
| DE | 41 04 215 A1 | 8/1992 |
| DE | 20 2005 016 024 U1 | 3/2006 |
| EP | 1775798 A1 | 4/2007 |

* cited by examiner

*Primary Examiner* — Ross Gushi

(74) *Attorney, Agent, or Firm* — Schwabe, Williamson & Wyatt

(57) ABSTRACT

An electrical connector with a first coupling device with a first connection for a first electrical cable and a second coupling device with a second connection for a second electrical cable and wherein both coupling devices are interlocking for electrical contact. The second coupling device includes a first component to contact the first coupling device by interlocking, a second component that includes the second connection, and a coupling device for electrical coupling of the first component with the second component, wherein both components are flexible relative to each other in radial and/or axial direction.

23 Claims, 3 Drawing Sheets

ELECTRICAL CONNECTORS AND COUPLING DEVICE FOR SUCH A CONNECTOR

CROSS REFERENCE TO RELATED APPLICATIONS

The present application claims international priority under 35 U.S.C. §119 to co-pending European Patent Application No. 07013728.6 filed Jul. 12, 2007, entitled "Elektrischer Steckverbinder Sowie Verbindungseinrichtung fur einen Solchen Steckverbinder," the entire content and disclosure of which is hereby incorporated by reference in its entirety for all purposes except for those sections, if any, that are inconsistent with this specification.

FIELD OF THE INVENTION

The present invention relates to an electrical connector with a first coupling device that includes a first connection for a first electrical cable and a second coupling device that includes a second connection for a second electrical cable, wherein both coupling devices are interlocking for electrical contact.

BACKGROUND

Connectors of the type referred to above are well known. These are, for example, circular connectors. They offer little or no room for adjustment of radial tolerances, typically only a few 1/100 mm. The reason for this is that the elasticity of lamella fields typically used in such circular connectors does not permit any more adjustment. If such a circular connector is charged in radial direction high lateral forces arise. These are detrimental to the relaxation behavior of the lamellae. Generally, axial movements in known solutions cause a high degree of wear.

SUMMARY

The present invention is directed to improving a connector of the aforementioned kind such that it is not, or only slightly affected, by mechanical stress in the axial and/or radial direction.

According to the present invention, problems associated with the prior art may be solved by a second coupling device having a first component to contact a first coupling device via interlocking, a second component that includes a second connection, and a coupling device for electrical coupling of the first component with the second component, wherein both components are flexible relative to each other in a radial and/or an axial direction.

In other words, at least one of the two coupling devices may be divided into two parts, with one part featuring a cable connection and the other part serves as a connection with the other coupling device. Since both components are flexible in a radial and/or an axial direction relative to each other, axial and/or radial movements, for example, of the first component may be compensated by a corresponding relative movement of the second component. The coupling device serves to bring about the electrical connection of the first coupling device with the cable connection of the second coupling device.

According to some embodiments of the present invention, a first limiting device may be provided to limit relative movement of both components in the radial direction to a first predetermined dimension.

In accordance with some embodiments, the total arrangement may be limited to a given space. A first predetermined dimension according to the present invention, for example, falls in a range of 0.1 mm $\leqq d \leqq$ 0.5 mm, and preferably 0.2 mm $\leqq d \leqq$ 0.4 mm.

In the same way, according to some embodiments of the present invention, a second limiting device may be provided for limiting the relative movement of both components in an axial direction to a second predetermined dimension.

In accordance with various embodiments of the present invention, the second limiting device provides a counterforce with respect to the relative motion of the two components in the axial direction with a spring constant of a maximum of 13 N/mm. In accordance with various embodiments of the present invention, the second limiting device provides a counterforce with respect to the relative motion of the two components in the axial direction with a spring constant of a maximum of 11 N/mm. In accordance with various embodiments of the present invention, the second limiting device provides a counterforce with respect to the relative motion of the two components in the axial direction with a spring constant of a maximum of 9 N/mm.

The second predetermined dimension, in accordance with some embodiments of the present invention, for example, may fall in a range 0.15 mm $\leqq s \leqq$ 0.45 mm, preferably 0.2 mm $\leqq d \leqq$ 0.4 mm, and more preferably 0.25 mm $\leqq d \leqq$ 0.35 mm.

Furthermore, according to some embodiments of the present invention, the second limiting device may be attached to the first and the second component, and deformable. In other words, the two components may feature a permanent connection which, in order to ensure the relative movement, is deformable. In accordance with some embodiments, the second limiting device being at least partially strip-like. A strip offers an advantage of low resistance when ramming, combined with high tensile strength.

According to an embodiment of the present invention, an area within the first and/or the second component may be provided to at least partially accommodate the second limiting device in case of ramming. This helps assure that the second limiting device in each position, when in operation, is within a protected space for its optimal protection.

According to an embodiment of the present invention, the second limiting device is electrically conducting. This allows for the transfer of electricity.

To simplify the overall design, according to embodiments of the present invention, the second limiting device and the coupling device may coincide. In other words, the coupling device may serve a dual purpose, namely to to provide electrical connection and, on the other hand, to limit the relative movement of both components relative to each other.

Furthermore, the coupling device according to embodiments of the present invention may be located, at least partially, within the first and/or the second component. Such a design in turn protects the coupling device (which may be identical with the second limiting device) from damage.

The first component may provide a stop that is hit by a second stop of the second component in case of axial movement of the second component relative to the first coupling device. In such a design an axial movement of the second component may be sufficient to connect the first component with the first coupling device.

In accordance with various embodiments of the present invention, the first and/or the second stop are/is shaped at an angle. Such a design may ensure that the contact between the first and second coupling device is built reliably and with a steady increase in force during the coupling process.

According to the present invention, the first limiting device may have an attachment at the first or second component crossways to the radial direction that is connected with clearance to a recess in the second or first component. In other words, both components may be connected in a plug/socket configuration, however, with radial clearance to allow radial relative motion, however, not more than permitted by the clearance.

According to an embodiment of the present invention, the second limiting device may prevent the attachment from leaving the recess. In other words, the second limiting device may serve to keep the attachment in the recess. Thus, both limiting devices work together in this regard.

In accordance with various embodiments, the first coupling device may be a socket and the second coupling device may be a plug fitting the socket. However, it may also be precisely the opposite.

In addition to the entire connector, the present invention also encompasses just one of the two coupling devices for such a connector, especially the one that is divided into the two components with the coupling device in between. Thus, the coupling device according to the present invention may be a plug.

DETAILED DESCRIPTION

Figure 1:
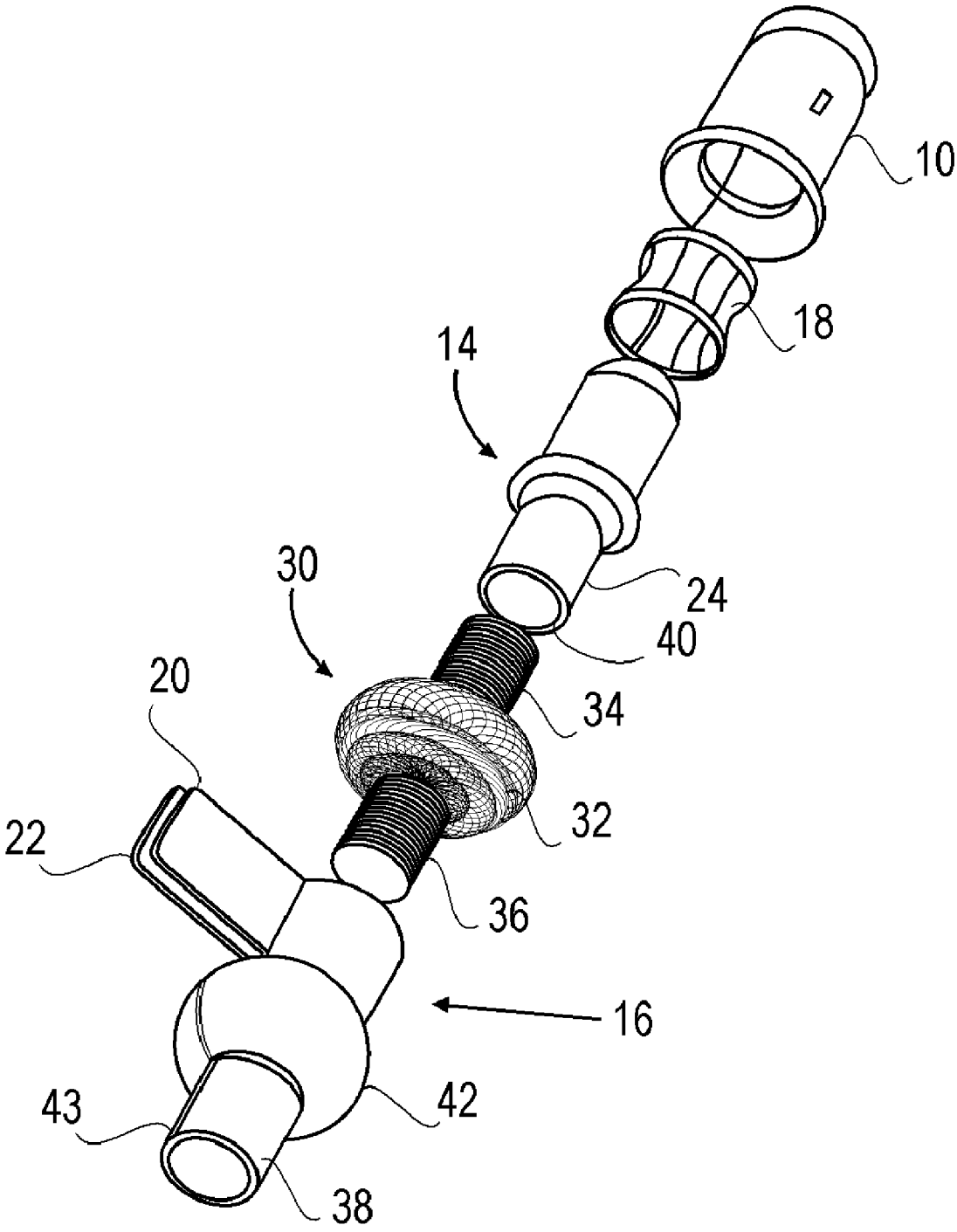
FIG. 1 is a perspective exploded view of an embodiment of a connector, in accordance with various embodiments of the present invention.
Figure 2:
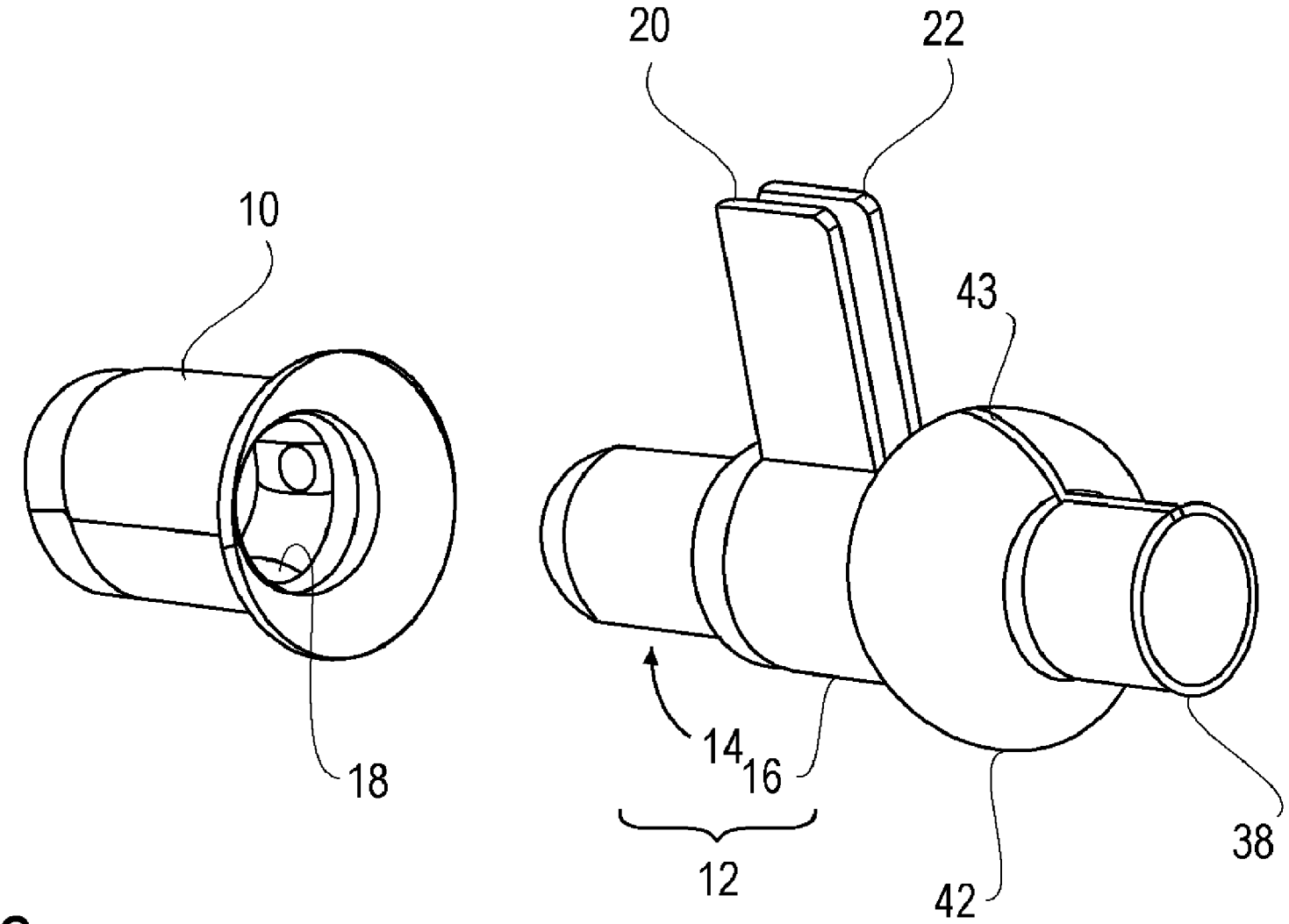
FIG. 2 is an enlarged perspective view of two coupling devices of the connector shown in FIG. 1.

A connector illustrated in the figures comprises a socket listed as coupling device 10 and a plug listed as coupling device 12. The second coupling device 12 comprises a first component 14 and a second component 16. Socket 10 includes lamellae, one of which is labeled with reference number 18. It serves as a connection point for an electrical cable (not shown).

Figure 3:
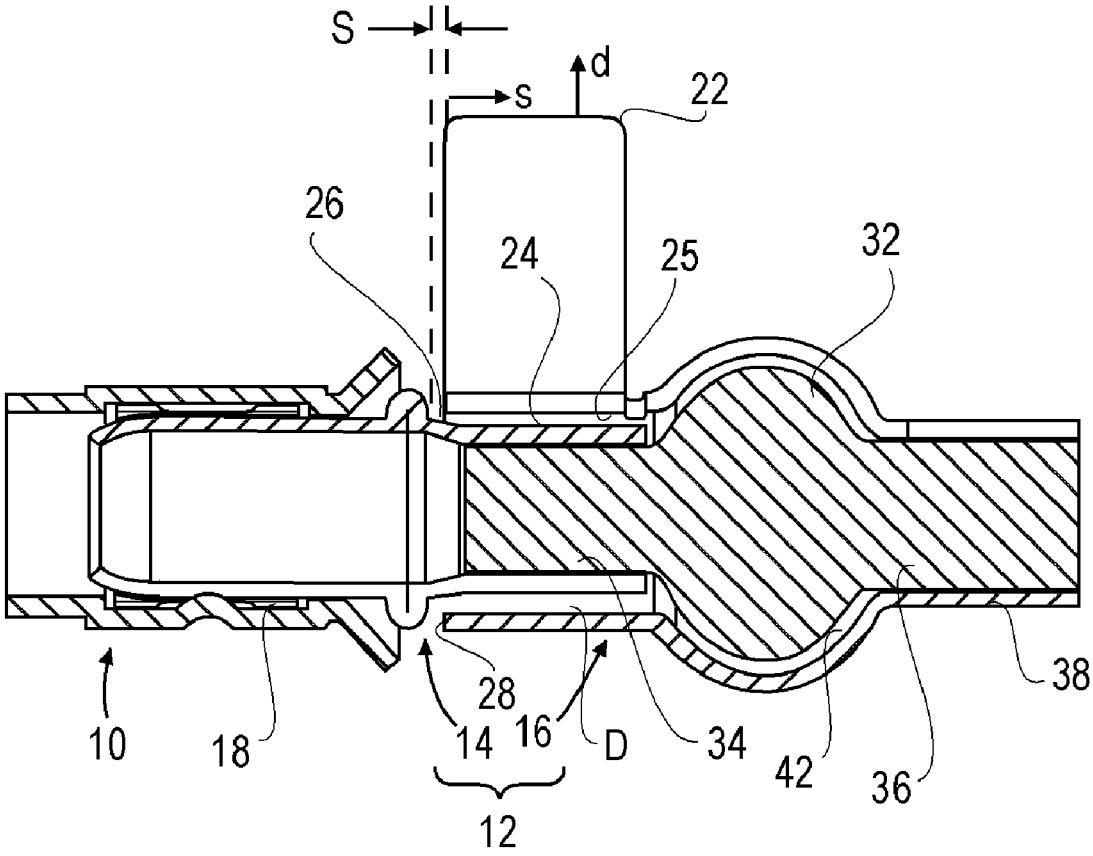
FIG. 3 is a partial longitudinal view of the connector shown in FIG. 1.

In a similar way, lobes 20 and 22 of the second coupling device serve as connection for a cable not shown. It is welded onto lobes 20 and 22. Part 24 of the first component, when assembled, extends into recess 25 of the second component 16. With respect to its longitudinal axis, it has a tapering stop 26, which is hit by the face 28 of the second component 16 when moved to the left, as illustrated in FIG. 3. Thus, by applying pressure on the second component 16, the first component 14 is inserted in socket 10, making contact with lamella 18 reliably and with a steady increase in force.

According to various embodiments of the present invention, a hose 30 made from a conducting mesh ribbon serves to couple electrically and mechanically the first component 14 and the second component 16. It may be made from copper and may have a spring constant of, for example, 9 N/mm. In accordance with various embodiments, it may have a spring constant of, for example, 11/mm or 13 N/mm. Thus, the spring constant of the hose 30 may be in a range of, for example, 9 N/mm to 13 N/mm. As may be seen in FIG. 1, hose 30 may be totally flexible. For example, it may bulge when being moved in the axial direction. Such a bulge 32 is illustrated in FIG. 1. Hose 30 is crimped in a first section 34 to part 24 of the first component 14 and crimped in a second section 36 with part 38 of the second component 16. This crimping may be done by reducing the respective diameter that is possible because of the rolling design of components 14 and 16 with slits 40 and 43.

At this point it may be noted that hose 30 illustrated in FIG. 3 is not shown in a cross-sectional view, but indicated as a shaded area. Sections 34 and 36 and bulge 32 are illustrated.

In order to be able to form bulge 32 when hose 30 is being moved axially, the second component may also be built in a bulging manner with space 42.

In FIG. 3, distance "S" between the first component 14 and the second component 16 is illustrated. In the depiction of FIG. 3, the second component 16 may be movable to the right relative to the first component 14 until hose 30 is stretched. In the embodiment illustrated, this corresponds to a shift of s=0.4 mm.

Comparatively, the same applies to the radial direction. If, as illustrated in FIG. 3, in the position with distance "D" the second component 16 is moved to the right relative to the first component 14, face 28 no longer hits stop 26. Thus, the second component 16 may be moved relative to the first component 14, for example, upward by d=0.7 mm, as shown in FIG. 3.

According to the present invention, the connector illustrated in the figures is able to compensate mechanical stress in axial and radial directions by the relative movement of components 14 and 16, resulting in a substantial reduction of a negative impact, if not its complete elimination. The characteristics of the present invention, as revealed in the present description, the claims and in the drawing are relevant for the realization of the various embodiments of the present invention by themselves or in any combination thereof.

The invention claimed is:

1. An electrical connector comprising:

a first coupling device including a first connection for a first electrical cable; and a second coupling device for interlocking with the first coupling device to form an electrical contact, the second coupling device comprising:

a first component for contacting the first coupling device via interlocking;

a second component that includes the second connection for a second electric cable;

an electrical coupling device in form of a flexible hose made from a conducting mesh ribbon for electrical and mechanical coupling of the first component with the second component, such that both components are movable relative to each other in every radial direction orthogonal to an axial direction; and a first limiting device limiting the relative motion of the two components to a first predetermined distance D in the radial direction.

2. An electrical connector according to claim 1, further comprising a second limiting device that is deformable and is coupled to the first and the second components.

3. An electrical connector according to claim 1, wherein the electrical coupling device is at least partially within the first and/or second component.

4. An electrical connector according to claim 1, wherein the first component comprises a first stop that may be hit by the second component with a second stop in case of axial movement of the second component relative to the first coupling device.

5. An electrical connector according to claim 4, wherein the first and/or second stop are angled.

6. An electrical connector according to claim 1, wherein the first coupling device is a socket and the second coupling device is a plug fitting the socket.

7. An electrical connector according to claim 1, wherein both components are movable relative to each other in the axial direction.

8. An electrical connector according to claim 1, wherein the first predetermined distance is in a range of 0.1 mm $\leqq D \leqq 0.5$ mm.

9. An electrical connector according to claim 8, wherein the first predetermined distance is in a range of 0.2 mm $\leqq D \leqq 0.4$ mm.

10. An electrical connector according to claim 1, further comprising a second limiting device limiting the relative motion of the two components in the axial direction to a second predetermined distance S.

11. An electrical connector according to claim 10, wherein the second limiting device provides a counterforce with a spring constant of a maximum of 13 N/mm against the relative motion of components in the axial direction.

12. An electrical connector according to claim 11, wherein the second limiting device provides a counterforce with a spring constant of a maximum of 11 N/mm against the relative motion of components in the axial direction.

13. An electrical connector according to claim 12, wherein the second limiting device provides a counterforce with a spring constant of a maximum of 9 N/mm against the relative motion of components in the axial direction.

14. An electrical connector according to claim 10, wherein the second predetermined distance is in a range of 0.15 mm $\leqq S \leqq 0.45$ mm.

15. An electrical connector according to claim 14, wherein the second predetermined distance is in a range of 0.2 mm $<S<0.4$ mm.

16. An electrical connector according to claim 15, wherein the second predetermined distance is in a range of 0.25 mm $<S<0.35$ mm.

17. An electrical connector according to claim 10, wherein the second limiting device is at least partially strip-like.

18. An electrical connector according to claim 10, wherein a space is defined within the first and/or the second component to at least partially accommodate the second limiting device.

19. An electrical connector according to claim 10, wherein the second limiting device is electrically conducting.

20. An electrical connector according to claim 10, wherein the second limiting device coincides with the coupling device.

21. An electrical connector according to claim 10, wherein the first limiting device comprises a part perpendicular to the radial direction of the first or second component and that extends with clearance into a recess at the second or the first component.

22. An electrical connector according to claim 21, wherein the second limiting device prevents the part from leaving the first recess.

23. An electrical connector comprising:

a first coupling device including a first connection for a first electrical cable; and a second coupling device for interlocking with the first coupling device to form an electrical contact, the second coupling device comprising:

a first component for contacting the first coupling device via interlocking;

a second component that includes the second connection for a second electric cable;

an electrical coupling device for electrical and mechanical coupling of the first component with the second component, such that the first component and the second component are movable relative to each other in every radial direction orthogonal to an axial direction; and a first limiting device limiting the relative motion of the two components to a first predetermined distance D in the radial direction;

wherein the electrical coupling device is arranged within the first and/or second component to be protected from damage.

* * * * *